US006546214B2

(12) United States Patent
Sakai et al.

(10) Patent No.: US 6,546,214 B2
(45) Date of Patent: Apr. 8, 2003

(54) IMAGE FORMING APPARATUS COMPRISING STORING MEANS FOR STORING A PARAMETER REGARDING AN ACCUMULATION OPERATION AMOUNT OF THE APPARATUS OR OF A CARTRIDGE DETACHABLY MOUNTABLE TO THE APPARATUS

(75) Inventors: Hiroaki Sakai, Shizuoka (JP); Seiji Saito, Shizuoka (JP); Takeshi Kawamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,112

(22) Filed: Jun. 25, 2001

(65) Prior Publication Data

US 2002/0018658 A1 Feb. 14, 2002

(30) Foreign Application Priority Data

Jun. 27, 2000 (JP) ..... 2000-192858

(51) Int. Cl.[7] ..... G03G 15/00; G03G 15/02; G03G 15/08

(52) U.S. Cl. ..... 399/38; 399/43; 399/46; 399/50; 399/53; 399/111

(58) Field of Search ..... 399/38, 43, 46, 399/24, 25, 50, 51, 53, 55, 111

(56) References Cited

U.S. PATENT DOCUMENTS

| | | | | |
|---|---|---|---|---|
| 5,572,292 A | * | 11/1996 | Chatani et al. | 399/25 |
| 5,956,541 A | * | 9/1999 | Hoshika et al. | 399/24 |
| 6,070,022 A | * | 5/2000 | Kobayashi et al. | 399/12 |
| 6,229,970 B1 | * | 5/2001 | Onimura et al. | 399/50 |
| 6,324,357 B1 | * | 11/2001 | Gomi et al. | 399/50 |

FOREIGN PATENT DOCUMENTS

| | | | |
|---|---|---|---|
| JP | 08-160680 | * | 6/1996 |
| JP | 09-190143 | * | 7/1997 |
| JP | 10-221938 | | 8/1998 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an image forming device for forming an image on a recording material, a storing device for storing a parameter regarding an accumulation operation amount of the image forming apparatus, and a changing device for changing an image forming condition of the image forming device in accordance with the parameter.

35 Claims, 10 Drawing Sheets

IMAGE FORMING APPARATUS COMPRISING STORING MEANS FOR STORING A PARAMETER REGARDING AN ACCUMULATION OPERATION AMOUNT OF THE APPARATUS OR OF A CARTRIDGE DETACHABLY MOUNTABLE TO THE APPARATUS

BACKGROUND OF THE INVENTION

1. Field of the Invention

The present invention relates to an image forming apparatus such as an electrophotographic copying machine, an electrophotographic printer and the like.

2. Related Background Art

In conventional electrophotographic image forming apparatuses using an electrophotographic image forming process, a process cartridge system in which an electrophotographic photosensitive member and process means acting on the electrophotographic photosensitive member are integrally incorporated as a cartridge unit, which can detachably be mounted to a main body of the image forming apparatus, has been used. According to such a process-cartridge system, since maintenance of the apparatus can be performed by an operator himself without any expert, operability can be enhanced considerably. Thus, the process-cartridge system has widely been used with the electrophotographic image forming apparatus.

In a representative process cartridge, at least one of electrifying means, cleaning means and developing means, and an electrophotographic photosensitive member are integrally incorporated as a cartridge unit that can detachably be mounted to a main body of the image forming apparatus.

In such a process cartridge, the developing means comprises a developing member as developing means, and a developer containing portion containing developer (referred to as "toner" hereinafter).

When the process cartridge is used for a long time, the photosensitive drum is worn to generate a poor image, plagued by fog. To cope with this, conventionally, as means for notifying the user of the end of the service life of the photosensitive drum, there has been developed a technique in which the total number of revolutions of the photosensitive drum or the total rotating time of the photosensitive drum is detected, and, when the detected value exceeds a predetermined value, it is judged that the end of the service life of the photosensitive drum is reached.

Further, as improvement, there has been proposed a technique in which the total applying time of the AC current applied to the electrifying means is also considered, as well as the total number of revolutions of the photosensitive drum or the total rotating time of the photosensitive drum.

Further, there has been proposed a technique in which the number of revolutions of the photosensitive drum or the rotating time of the photosensitive drum is stored in an IC memory (for example, an EEPROM) as storing means attached to a drum unit having the photosensitive drum or to the process cartridge of an integral type. As the IC memory, Japanese Patent Application Laid-Open No. 10-221938 also discloses a memory of non-contact type.

As the electrophotographic image forming apparatus utilizing the process cartridge system, an example of a conventional laser beam printer is shown in FIG. 9.

The laser beam printer includes a photosensitive drum 101, an exposing apparatus 102, a developing apparatus 103, a transferring member 104, a cleaning apparatus 105, an electrifying member 106, a fixing apparatus 107, a sheet feeding cassette B containing transfer materials, and a sheet feeding apparatus 108. The photosensitive drum 101, the developing apparatus 103, the cleaning apparatus 105 and the electrifying member 106 constitute a process cartridge C.

By projecting a laser beam L corresponding to image information from the exposing apparatus 102 onto a surface of the photosensitive drum 101 electrified with a desired potential by the electrifying member 106 to remove electricity, an electrostatic latent image is formed on the photosensitive drum 101.

The developing apparatus 103 includes a developing container 133 as a developer containing portion containing toner T, a developing sleeve 131 as a developing member, and a doctor blade 132. The toner T is supplied from the developing sleeve 131 to the electrostatic latent image on the photosensitive drum 101, thereby forming a toner image. Thereafter, the toner image on the photosensitive drum 101 is transferred onto a surface of the transfer material P by means of the transferring member 104. The unfixed toner image on the transfer material P is permanently fixed to the transfer material P with heat and pressure by means of the fixing apparatus 107. Then, the transfer material is discharged out of the printer.

On the other hand, after the transferring operation, residual matter, such as toner and paper powder, remaining on the photosensitive drum 101 is removed by the cleaning apparatus 105.

Further, a toner-remaining-amount detecting rod 111 is disposed in parallel with the developing sleeve 131 so that the remaining amount of toner is detected by detecting the electrostatic capacity between the developing sleeve 131 and the rod.

In the image forming apparatus using the process-cartridge system, as the process cartridge is being continuously used from a new cartridge, an image property is changed.

The image property is changed because of a fluctuation in the sensitivity of the photosensitive drum and a fluctuation in the toner electrifying condition. The fluctuation in the sensitivity of the photosensitive drum is caused by repeatedly performing electrification, exposure, and electricity removal. Under the same image forming condition, if the sensitivity of the photosensitive drum tends to be increased, by repeating the image forming operations, when the device tries to produce identical lines, the produced lines will become gradually fat. Conversely, if the sensitivity of the photosensitive drum tends to be decreased, when the device tries to produce identical lines, the produced lines will become gradually thin.

Further, regarding the toner electrifying condition, the electrifying amount is gradually increased by repeating the image forming operations from a condition that the toner is new. If the amount of toner electrified within a proper range is increased, when the device tries to produce identical lines, the produced lines will become gradually fat. Conversely, if the electrifying amount of toner is increased to exceed the proper range, when the device tries to produce identical lines, the produced lines will become gradually thin. Such a phenomenon is apt to occur particularly in a low humidity environment.

In consideration of such a fluctuating property, generally, a saturated level of the fluctuating property is set as a proper range of image. Thus, regarding the whole use range of the process cartridge, it is set so that the optimum image forming conditions are a maximum.

FIG. 10 shows a fluctuation in a line width as a function of an accumulation operation time of the process cartridge. This figure shows an example of a case where the image forming condition is set as a reference value of 200 $\mu$m (line width) and the drum sensitivity and the developing property have a tendency to increase. Particularly, the fluctuating property in which the line width is abruptly fluctuated at an initial stage and then gradually approaches to 200 $\mu$m as the accumulation operation time of the process cartridge is increased is shown.

SUMMARY OF THE INVENTION

Accordingly, an object of the present invention is to provide an image forming apparatus in which the fluctuation in the image forming property caused by an accumulation operation of a process cartridge or the image forming apparatus can be minimized.

The other objects and features of the present invention will be apparent from the following detailed explanation of the invention referring to the accompanying drawings.

DETAILED DESCRIPTION OF THE PREFERRED EMBODIMENTS

The present invention will now be explained in connection with embodiments thereof with reference to the accompanying drawings.

First Embodiment

Now, a first embodiment of the present invention will be described with reference to FIGS. 1 to 4.

Figure 1:
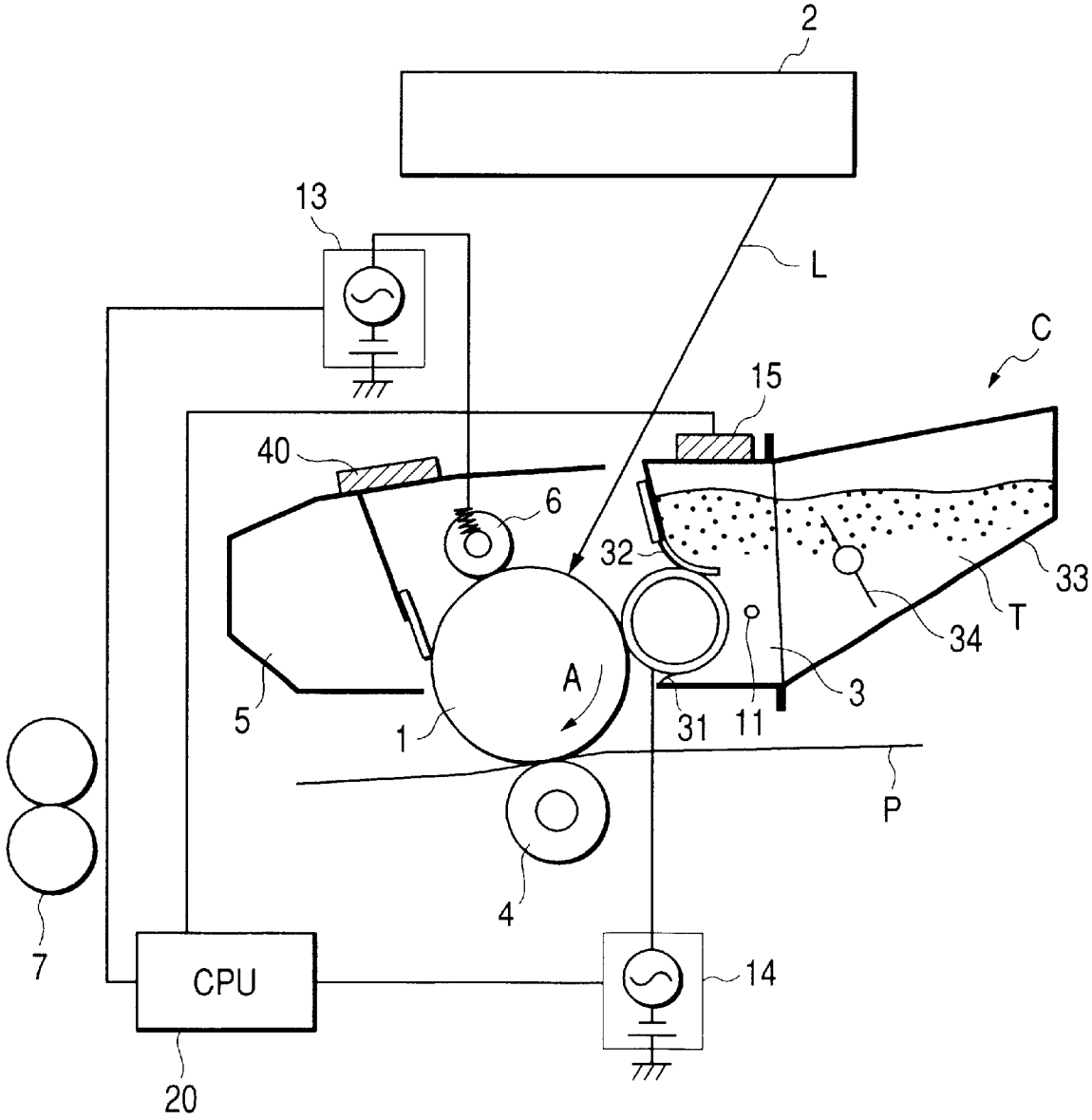
FIG. 1 is a schematic view showing an embodiment of an image forming apparatus on which a process cartridge according to the present invention is mounted.

An image apparatus according to the first embodiment is embodied as a laser beam printer in which, as shown in FIG. 1, a photosensitive drum 1 as an electrophotographic photosensitive member is rotated in a direction shown by the arrow A by means of a driving means (not shown) of a main body of the image forming apparatus. After a surface of the photosensitive drum 1 is uniformly electrified by electrifying means 6, such as an electrifying roller of the contact type, laser light (beam) L from an exposing apparatus 2 illuminates the surface of the photosensitive drum, thereby forming an electrostatic latent image. Electrostatic latent image forming means is constituted by the electrifying means 6 and the exposing apparatus 2.

A developing apparatus 3 includes a toner container 33 as a developer containing portion containing magnetic one-component high resistive toner T as developer, a developing sleeve 31 as a developing member that is rotatable and does not contact the photosensitive drum 1, a toner-layer-thickness regulating member 32 for regulating the thickness of a toner layer on the developing sleeve 31, and agitating means 34 for supplying the toner T to the developing sleeve 31. The toner T is held on the developing sleeve 31 by a magnetic force of a fixed magnet disposed within the developing sleeve 31, and the toner T is electrified with a predetermined electrifying amount by friction between the toner and the rotating developing sleeve 31 and friction between the toner and the toner-layer-thickness regulating member 32. By applying AC+DC bias from a developing bias power supply 14 to the developing sleeve 31, a potential difference is generated between the developing sleeve 31 and the electrostatic latent image on the photosensitive drum 1, with the result that the toner T is transferred from the developing sleeve 31 onto the electrostatic latent image, thereby developing the electrostatic latent image as a toner image.

The toner image on the photosensitive drum 1 is transferred onto a sheet P, such as a recording paper, as a recording medium by means of transferring means 4. Residual toner remaining on the photosensitive drum 1 is removed by a cleaning apparatus 5, for preparing for the next image formation operation.

The sheet P to which the toner image was transferred is sent to a fixing apparatus 7, where the toner image is fixed to the sheet by heat and pressure. Thereafter, the sheet is discharged out of the printer.

In the illustrated embodiment, the photosensitive drum 1, the electrifying means 6, the developing apparatus 3 and the cleaning apparatus 5 are integrally incorporated as a process cartridge C that can detachably be mounted to the main body of the image forming apparatus via mounting means 40. It is preferable that the process cartridge includes the photosensitive drum 1, and at least one of the electrifying means 6, the developing apparatus 3 and the cleaning apparatus 5.

Further, in the developing apparatus 3, a remaining-amount detecting rod 11 is disposed in parallel with the developing sleeve 31 so that the remaining amount of the toner is detected by detecting the electrostatic capacity between the developing sleeve 31 and the rod.

Further, in the illustrated embodiment, storing means 15 is mounted to the process cartridge C. An EEPROM is used as the storing means 15.

Incidentally, the main body of the image forming apparatus includes an electrifying bias power source 13, a CPU 20 and electrical circuits as various signal processing means, and a recording-paper conveying system, as well as the above-mentioned exposing means 2, the transferring means 4, the developing bias power source 14 and the fixing apparatus 7.

Next, characteristic portions of the present invention will be explained. The illustrated embodiment relates to correction of an image forming property fluctuated in a direction along which a developing property is increased due to an accumulation operation of the process cartridge or the developing apparatus, and, in the illustrated embodiment, the image forming property is corrected by changing the setting of the developing contrast.

FIGS. 2A to 2D show potential relationships between the photosensitive drum 1 and the developing sleeve 31 during the image formation operation.

Figure 2A:
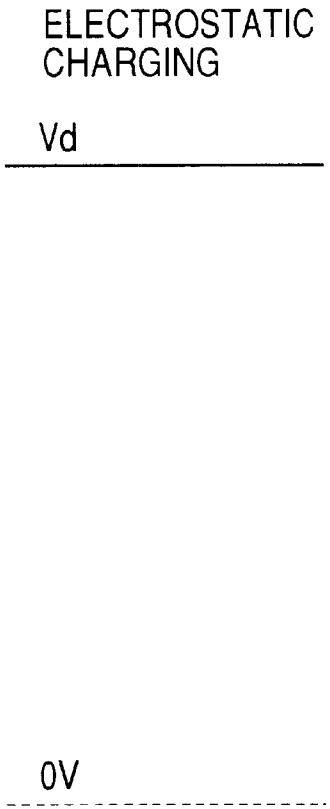
FIGS. 2A, 2B, 2C and 2D are views showing potential relationships of a photosensitive drum in the first embodiment.
Figure 2B:
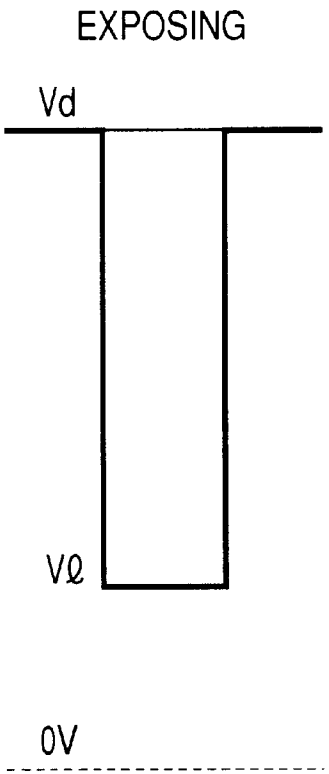
Figure 2C:
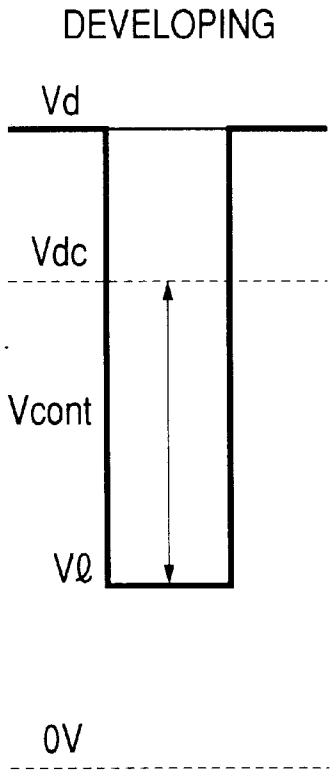
Figure 2D:
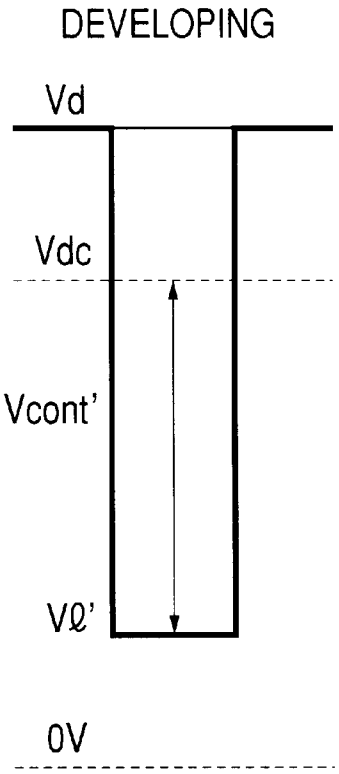

FIG. 2A shows the fact that the photosensitive drum is set to predetermined potential Vd (dark potential) by means of the electrifying roller 6, and FIG. 2B shows the fact that a portion laser-exposed by the exposing apparatus 2 is changed to Vl (light potential). FIG. 2C shows the fact that the toner is developed at an area corresponding to developing contrast Vcont=Vdc−Vl, by applying DC bias of Vdc to the developing sleeve 31. FIG. 2D shows a change in developing contrast when the accumulation-operation amount is increased and thus shows the fact that, when Vl is changed to Vl' , the developing contrast Vcont is changed to Vcont' to increase the developing amount.

In the illustrated embodiment, when the accumulation operation amount is increased, DC bias Vdc for the developing sleeve 31 is changed on the basis of the accumulation electrifying time in order to correct the fluctuation in sensitivity of the photosensitive drum 1, i.e., the change in Vl. Incidentally, more specifically, the dark potential Vd of the photosensitive drum 1 was selected to −650 V, the initial light potential Vl of the photosensitive drum 1 was selected to −200 V, and the stable light potential Vl' was selected to −170 V.

Figure 3:
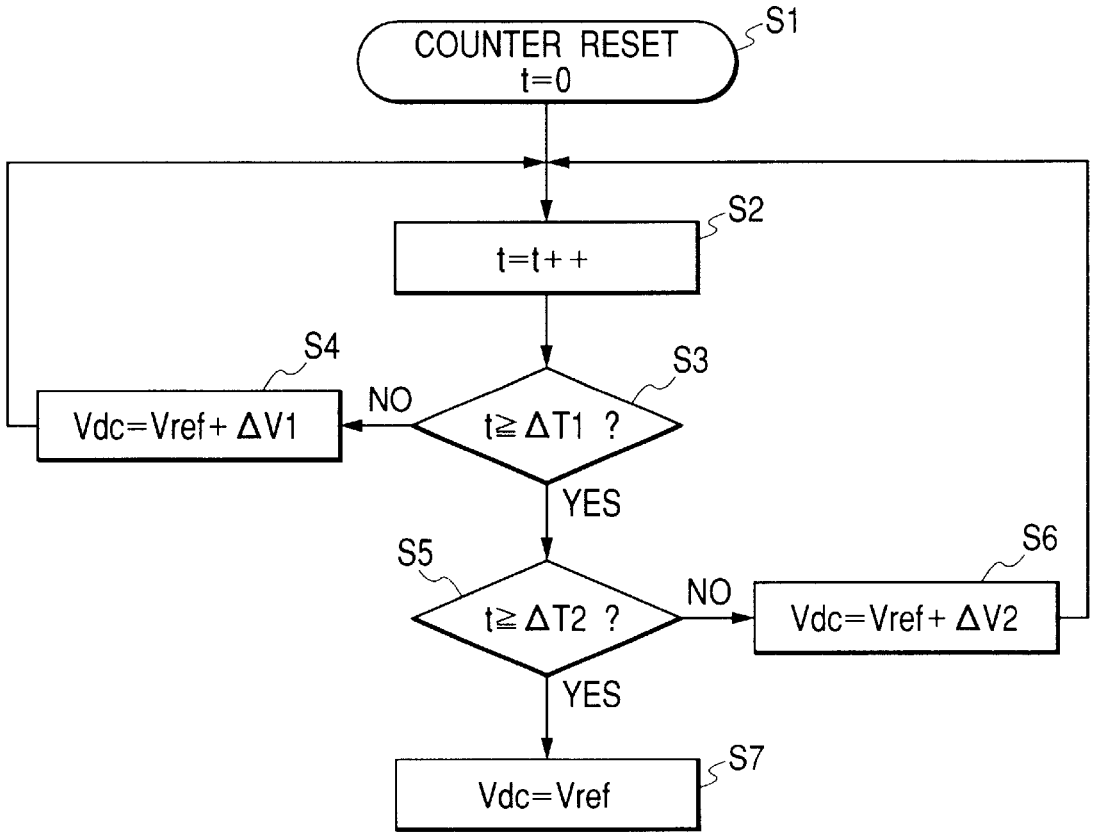
FIG. 3 is a flow chart for changing an image forming condition.
Figure 4:
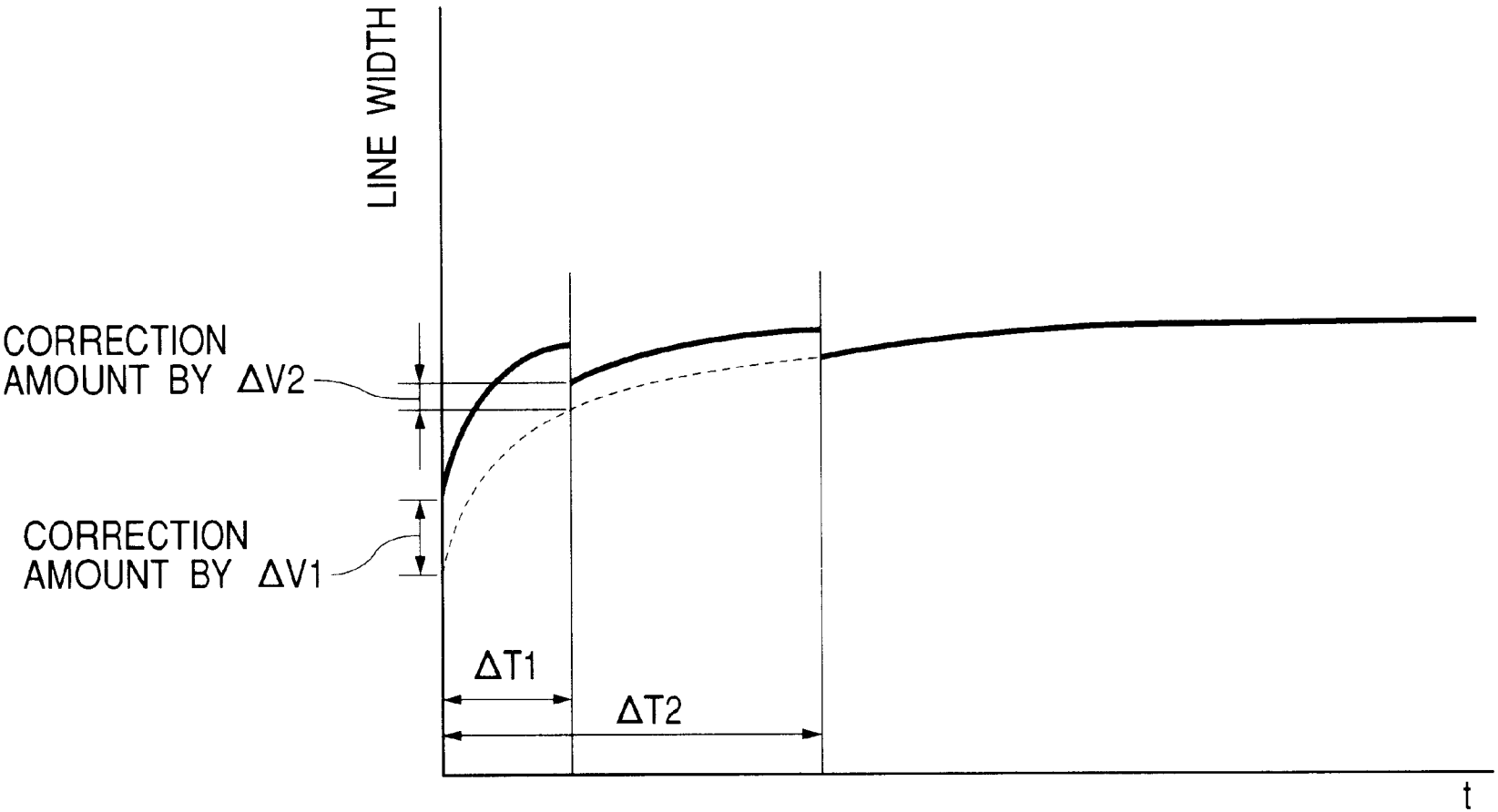
FIG. 4 is a graph showing the fluctuation in line width due to an accumulation operation of the process cartridge.

FIG. 3 is a flow chart for changing the image forming condition, and FIG. 4 shows a fluctuating property of the line width when Vdc is changed.

First of all, by effecting count reset (t=0) of the accumulation operation of the process cartridge C, the fluctuating operation according to the illustrated embodiment is started (step S1). In the illustrated embodiment, as a parameter regarding the accumulation-operation time, the electrifying time t is measured, and, the value t is increased whenever the electrifying time is increased, and the value is stored in the EEPROM 15 of the process cartridge C (step S2). It is judged whether the accumulation electrifying time t exceeds a predetermined electrifying time ΔT1 (t≧ΔT1) (step S3). If the accumulation electrifying time t is less than the predetermined electrifying time ΔT1 (t<ΔT1), Vdc is set to a value obtained by adding ΔV1 to reference voltage Vref (step S4). On the other hand, if the electrifying time is greater than ΔT1, it is judged whether the accumulation electrifying time t is equal to or greater than a predetermined electrifying time ΔT2 (t≧ΔT2) (step S5). If the accumulation electrifying time is less than ΔT2 (t<ΔT2), Vdc is set to a value obtained by adding ΔV2 to the reference voltage Vref (step S6). If the accumulation electrifying time t is equal to or greater than the predetermined electrifying time ΔT2 (t≧ΔT2), Vdc is set to Vref (Vdc=Vref) (step S7).

The reference voltage Vref is a set value of the developing DC bias capable of realizing a target image forming property, and, in the illustrated embodiment, the reference voltage Vref is selected to −500 V.

By effecting the above-mentioned control, as shown in FIG. 4, in comparison with a broken line showing no change of Vdc, the line width is corrected to a level nearer to the proper value, and the line width is shifted as shown by the solid lines. Incidentally, since the fluctuation of the image forming property exhibits a successive approximation, by setting the reference voltage so that the changing amount of the image forming condition from the reference value is a maximum at the initial stage and the changing amount is gradually decreased whenever the image forming condition is changed, the fluctuation of the image forming property after the changing can be reduced further. That is to say, when it is assumed that the initial value is V(O) and the changing number of the image forming condition is N (integral number greater than 1), the changing amount V(N) of the image forming condition from the reference value satisfies the following relationship:

$$V(N+1)<V(N).$$

Further, by setting the accumulation-operation-amount parameter so that the changing timing of the image forming condition is short at the initial stage (where the fluctuation in the image forming property is great) and subsequent timings become longer, the fluctuation of the image forming property after the changing can be further reduced. That is to say, when it is assumed that N is an integral number greater than 1, a relationship between the accumulation-operation-amount parameter t(N) of the process cartridge for changing the image forming condition and the changing number N of the image forming condition satisfies the following relationship:

$$t(N+2)-t(N+1)\geqq t(N+1)-t(N)\geqq t(1).$$

Incidentally, in the illustrated embodiment, it was set to have a relationships ΔT1=0.3×ΔT2 and ΔV1=2×ΔV2. However, if the fluctuating property is abrupt, ΔT1=ΔT2 may be set.

In the illustrated embodiment, while an example that two changing operations are effected was explained, any number of changing operations may be effected in dependence upon the fluctuating amount of the image forming property.

Further, in the illustrated embodiment, since the fluctuation in the sensitivity of the photosensitive drum is corrected, the count reset of the accumulation-operation-amount parameter of the process cartridge is not limited to the initiation of usage, but is effective also when the sensitivity of the photosensitive drum is returned to the initial condition due to a long term interruption of usage.

Further, in the initial stage of usage of the process cartridge, in consideration of the toner electrifying property, by setting the changing amount of the image forming property to a higher value, image formation with a nearer reference value can be achieved.

In the illustrated embodiment, since the electrifying time t is stored in the EEPROM 15 and the developing DC bias Vdc as the developing condition is changed on the basis of the stored value, the data is not lost even upon the mounting/dismounting of the process cartridge, and further, by storing the changing amounts ΔV1, ΔV2 of the developing DC bias and the accumulation electrifying times ΔT1, ΔT2 in the memory upon forwarding, manufacturing dispersion of the photosensitive drum and/or the toner can also be corrected.

Further, in the illustrated embodiment, while an example that the image forming condition is changed on the basis of the accumulation electrifying time as the parameter regarding the accumulation operation amount of the process cartridge was explained, the accumulation-operation amount is not limited to the electrifying time, but, even when the image forming condition is changed on the basis of the accumulation developing time, the accumulation transferring time, the accumulation rotating time of the photosensitive drum or the accumulation printed sheet number as the accumulation-operation amount, a similar effect can be achieved.

Second Embodiment

Next, a second embodiment of the present invention will be explained with reference to FIGS. 5A to 5D. FIGS. 5A to 5D show potential relationships between the photosensitive drum 1 and the developing sleeve 31 during image formation.

In the first embodiment, while an example that the image forming property is changed by changing only the DC bias Vdc applied to the developing sleeve 31 was explained, when only the DC bias Vdc is changed, the difference between the drum dark potential Vd and the bias Vdc, i.e., the back contrast Vback, will be changed. Although related to the toner electrifying property, if the value Vback becomes too small, since fog is increased, it is desirable that the value Vback is within the proper range of fog. In this embodiment, an example that the bias Vdc is changed and at the same time the dark potential Vd is changed will be described. That is to say, the developing condition and the electrifying condition as an electrostatic latent image forming condition are changed.

Figure 5A:
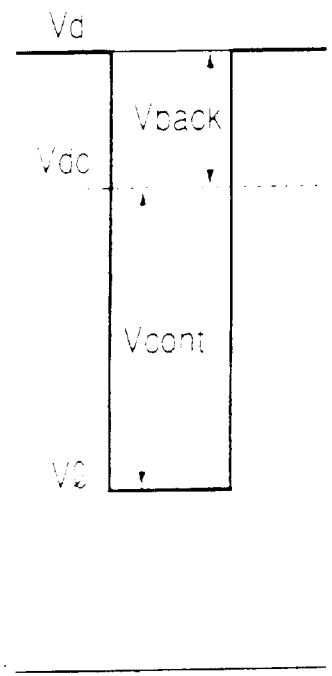
FIGS. 5A, 5B, 5C and 5D are views showing potential relationships of a photosensitive drum in a second embodiment of the present invention.
Figure 5B:
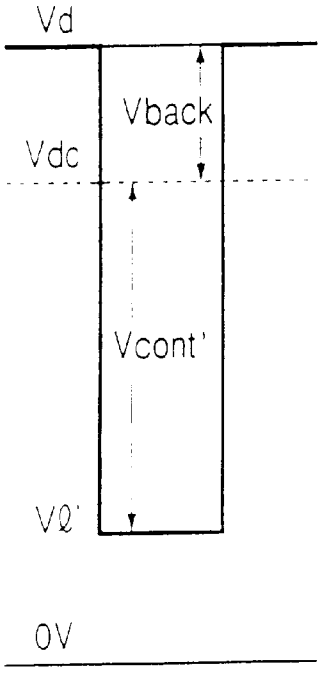

In FIGS. 5A to 5D, FIG. 5A shows the potential relationship without changing, where the developing contrast Vcont is Vdc−Vl (Vcont=Vdc−Vl) and the back contrast is Vd−Vdc (Vback=Vd−Vdc). FIG. 5B shows the potential relationship without changing under a condition that the image forming property is stabilized, where the developing contrast Vcont' is Vdc−Vl' (Vcont'=Vdc−Vl') and the back contrast is Vd−Vdc (Vback=Vd−Vdc).

Figure 5C:
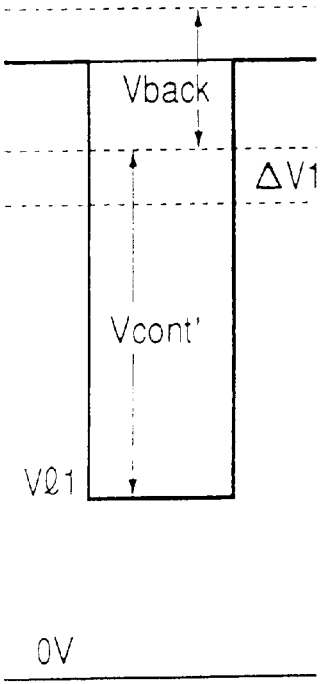

In the illustrated embodiment, also referring to the flow chart shown in FIG. 3, after the reset of the accumulation-operation amount of the process cartridge C, if the accumulation electrifying time is less than ΔT1, as shown in FIG. 5C, the developing DC bias and the dark potential of the photosensitive drum are changed by ΔV1 so that the developing contrast becomes Vcont' and the back contrast becomes Vback. Namely, the developing contrast becomes Vcont'=Vdc+ΔVl−Vl1 and the back contrast becomes Vback=(Vd+ΔVl)−(Vdc+ΔVl)=Vd−Vdc.

Figure 5D:
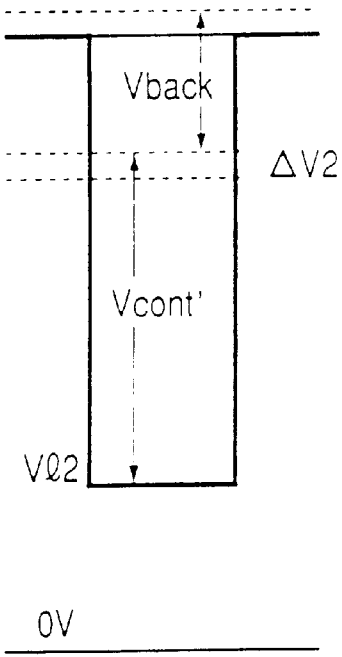

If the accumulation electrifying time is greater than ΔT1 and less than ΔT2, as shown in FIG. 5D, the developing DC bias and the dark potential of the photosensitive drum are changed by ΔV2 so that the developing contrast becomes Vcont' and the back contrast becomes Vback. Namely, the developing contrast becomes Vcont'=Vdc+ΔV2−Vl2 and the back contrast becomes Vback=(Vdc+ΔV2)=Vd−Vdc. Incidentally, in order to change the dark potential, for example, DC voltage applied to the electrifying roller 6 may be changed.

Also in the second embodiment, since the fluctuation of the image forming property exhibits a successive approximation, when the initial changing amount is great and the changing timing is small or short, image formation with a nearer reference value can be achieved. Accordingly, by setting the changing timing and the changing amount to be ΔT1=0.3×ΔT2 and ΔV1=2×ΔV2, respectively, an effect similar to the first embodiment can be achieved.

Third Embodiment

Next, a third embodiment of the present invention will be explained with reference to FIGS. 6A to 6C.

In the first and second embodiment, while examples that the image forming property is changed by changing the DC bias applied to the developing sleeve 31 or by changing both the DC bias Vdc and the drum dark potential Vd were explained, in a third embodiment, an example that a value of AC bias applied to the developing sleeve 31 as the developing condition is changed will be described. Further, in the third embodiment, the dark potential Vd of the photosensitive drum was set to −650 V, the DC bias Vdc of the developing sleeve was set to −500 V, the initial light potential of the photosensitive drum was set to −200 V, and the stable light potential Vl' was set to −170 V.

Figure 6A:
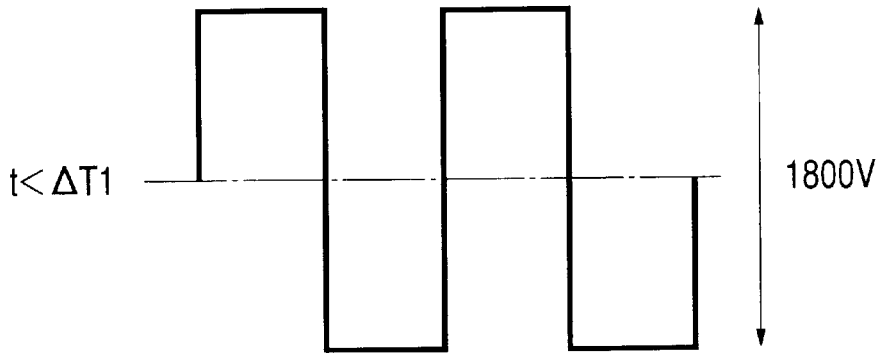
FIGS. 6A, 6B and 6C are views showing developing AC bias wave forms in a third embodiment of the present invention.
Figure 6B:
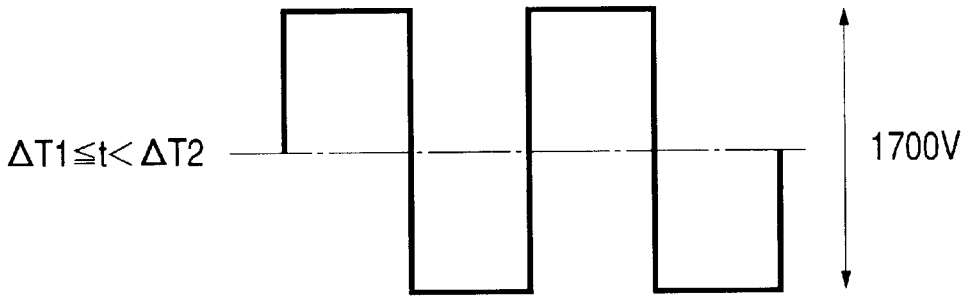
Figure 6C:
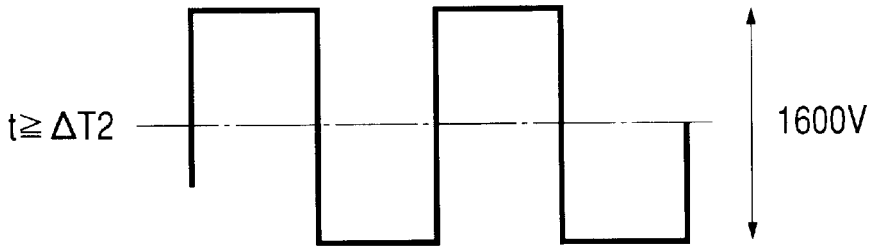

FIGS. 6A to 6C show wave forms of AC voltage applied to the developing sleeve 31 in the image formation according to the third embodiment. The wave form of the developing AC voltage is a rectangular wave, and, regarding reference values of image setting, Vpp is set to 1600 V, the frequency is set to 2000 Hz and the duty is set to 50%. Also in this embodiment, the image forming condition is changed by two times on the basis of the accumulation electrifying time t.

In FIGS. 6A to 6C, FIG. 6A shows the fact that Vpp is 1800 V when the accumulation electrifying time t is below ΔT1 (t<ΔT1), FIG. 6B shows the fact that Vpp is 1700 V when the accumulation electrifying time t is equal to or greater than ΔT1 and below ΔT2 (ΔT1≦t<ΔT2), and FIG. 6C shows the fact that Vpp is 1600 V when the accumulation electrifying time t is equal to or greater than ΔT2 (t≧ΔT2).

Further, similar to the above-mentioned embodiments. since image formation with a nearer reference value can be achieved when the initial changing amount is great and the changing timing is small or short, by setting the changing timing and the changing amount to be ΔT1=0.3×ΔT2 and ΔV1=2×ΔV2, respectively, an effect similar to the first embodiment can be achieved.

Fourth Embodiment

Next, a fourth embodiment of the present invention will be explained with reference to FIGS. 7A to 7C.

In the third embodiment, while an example that the image forming property is changed by changing the AC bias Vpp applied to the developing sleeve 31 was explained, in the fourth embodiment, the duty of the AC bias applied to the developing sleeve 31 is changed as the developing condition. In the illustrated embodiment, the dark potential Vd of the photosensitive drum was set to −200 V, the stable light potential was set to −170 V, the developing AC bias Vpp was set to 1600 V, and the frequency was set to 2000 Hz.

Figure 7A:
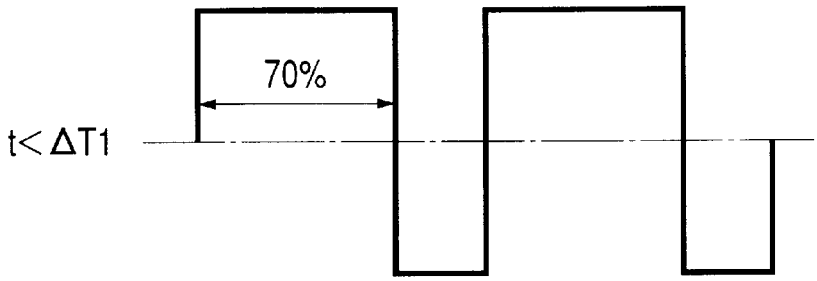
FIGS. 7A, 7B and 7C are views showing developing AC bias wave forms in a fourth embodiment of the present invention.
Figure 7B:
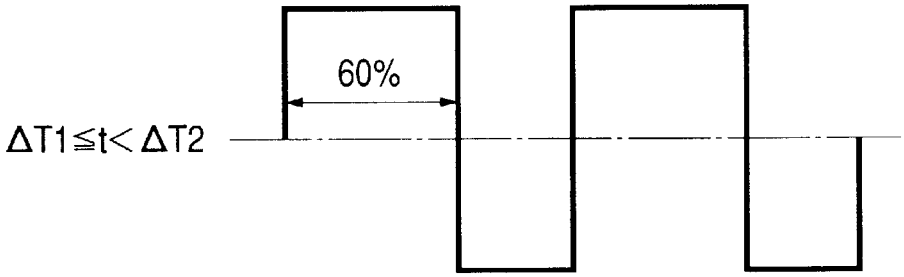
Figure 7C:
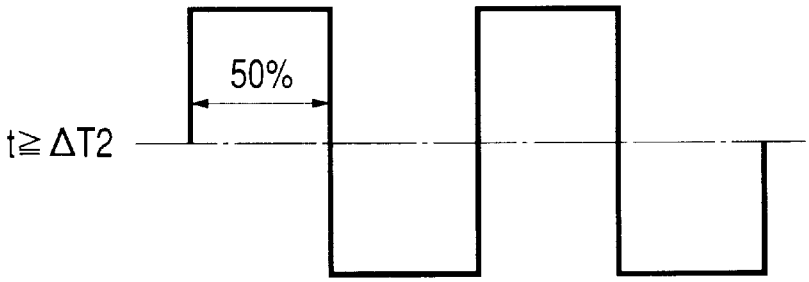

FIGS. 7A to 7C show wave forms of AC voltage applied to the developing sleeve 31 in the image formation operation according to the fourth embodiment. The wave form of the developing AC voltage is a rectangular wave, and, regarding reference values of image setting, Vpp is set to 1600 V, the frequency is set to 2000 Hz and the duty is set to 50%. Also in this embodiment, the image forming condition is changed by two times on the basis of the accumulation electrifying time t.

In FIGS. 7A to 7C, FIG. 7A shows the fact that developing side duty is 70% when the accumulation electrifying time t is below ΔT1 (t<ΔT1), FIG. 7B shows the fact that the developing side duty is 60% when the accumulation electrifying time t is equal to or greater than ΔT1 and below ΔT2 (ΔT1≦t<ΔT2), and FIG. 7C shows the fact that the developing side duty is 50% when the accumulation electrifying time t is equal to or greater than ΔT2 (t≧ΔT2).

Further, similar to the above-mentioned embodiments, since image formation with a nearer reference value can be achieved when the initial changing amount is great and the changing timing is small or short, by setting the changing timing and the changing amount to be $\Delta T1=0.3\times\Delta T2$ and $\Delta V1=2\times\Delta V2$, respectively, an effect similar to the first embodiment can be achieved.

Further, even when the output voltage value of the developing AC voltage shown in the third embodiment and the duty of the developing AC voltage according to the fourth embodiment are combined and these values are changed, a similar effect can be achieved.

Fifth Embodiment

Next, a fifth embodiment of the present invention will be explained with reference to FIG. 8.

In the above-mentioned embodiments, while an example that the high voltage setting of the image forming apparatus is changed was explained, in the fifth embodiment, an example that a laser light amount as an exposing condition (as the electrostatic latent image forming condition) is changed will be described. In this fifth embodiment, the dark potential Vd of the photosensitive drum was set to −650 V, the developing DC bias Vdc was set to −500 V, and the developing AC bias Vpp was set to 1600 V.

Figure 8:
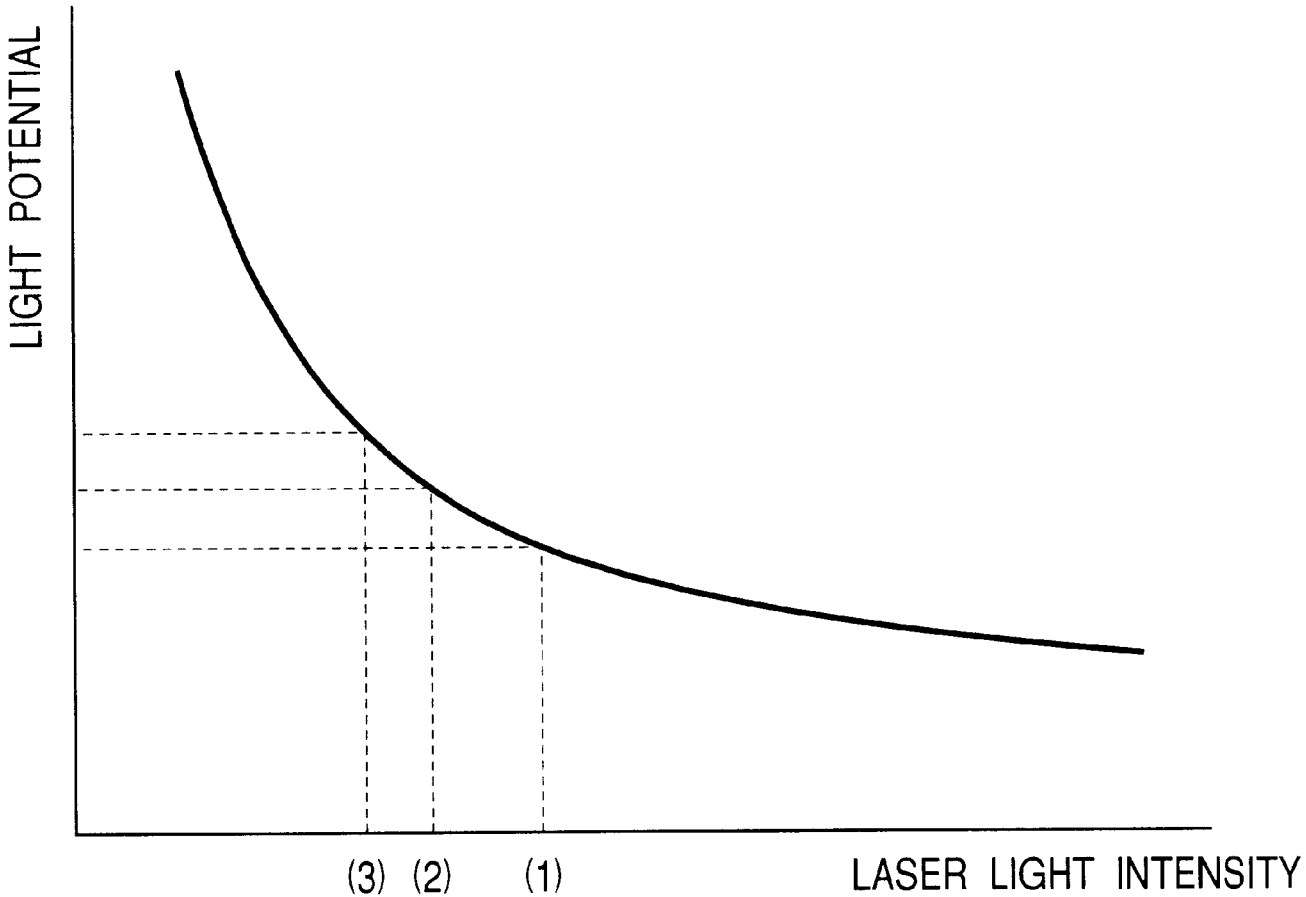
FIG. 8 is a graph showing the relationship between laser light intensity and light potential on a photosensitive drum in a fifth embodiment of the present invention.
Figure 9:
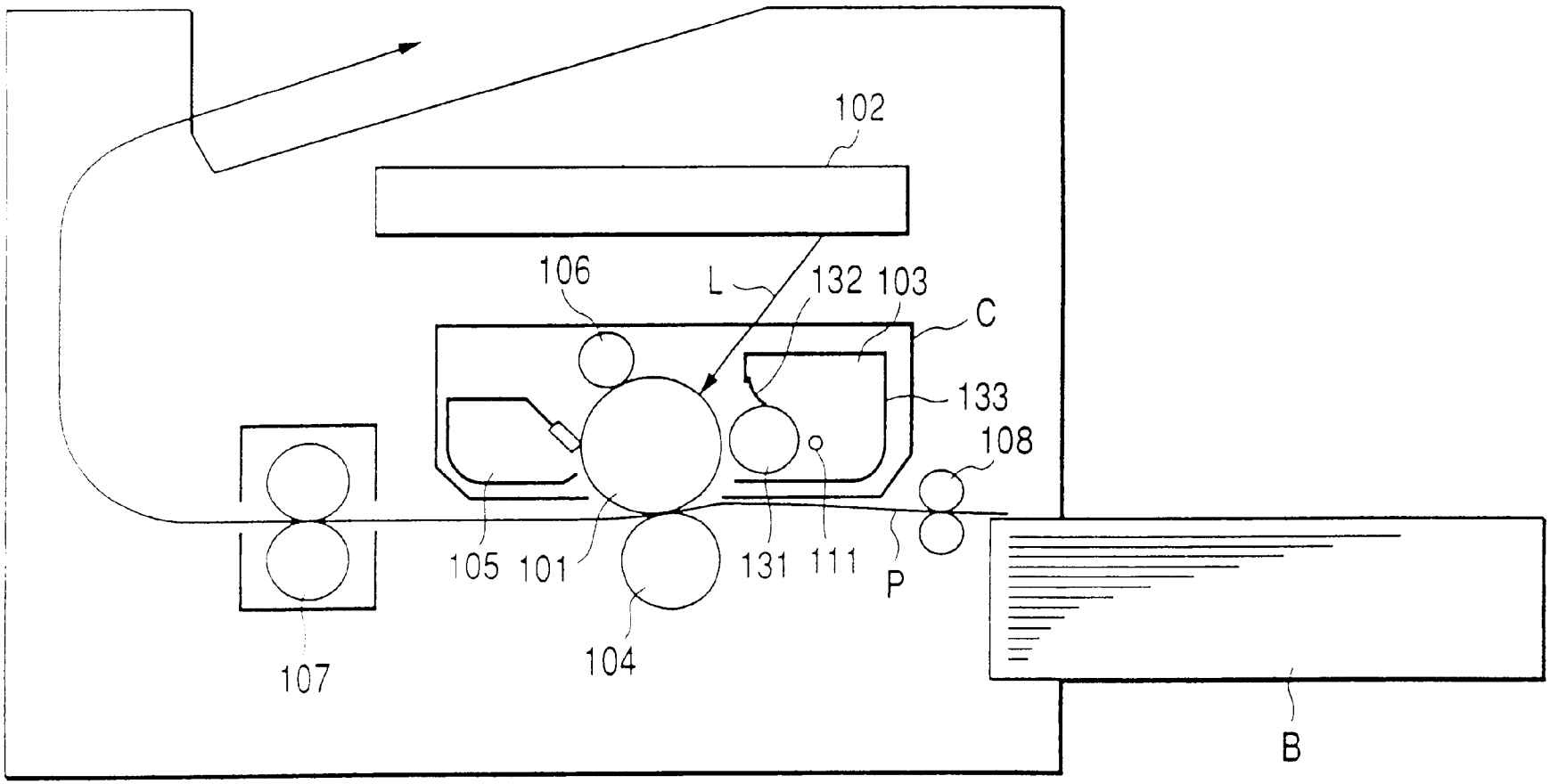
FIG. 9 (PRIOR ART)
FIG. 9 is a view showing an example of a conventional image forming apparatus.
Figure 10:
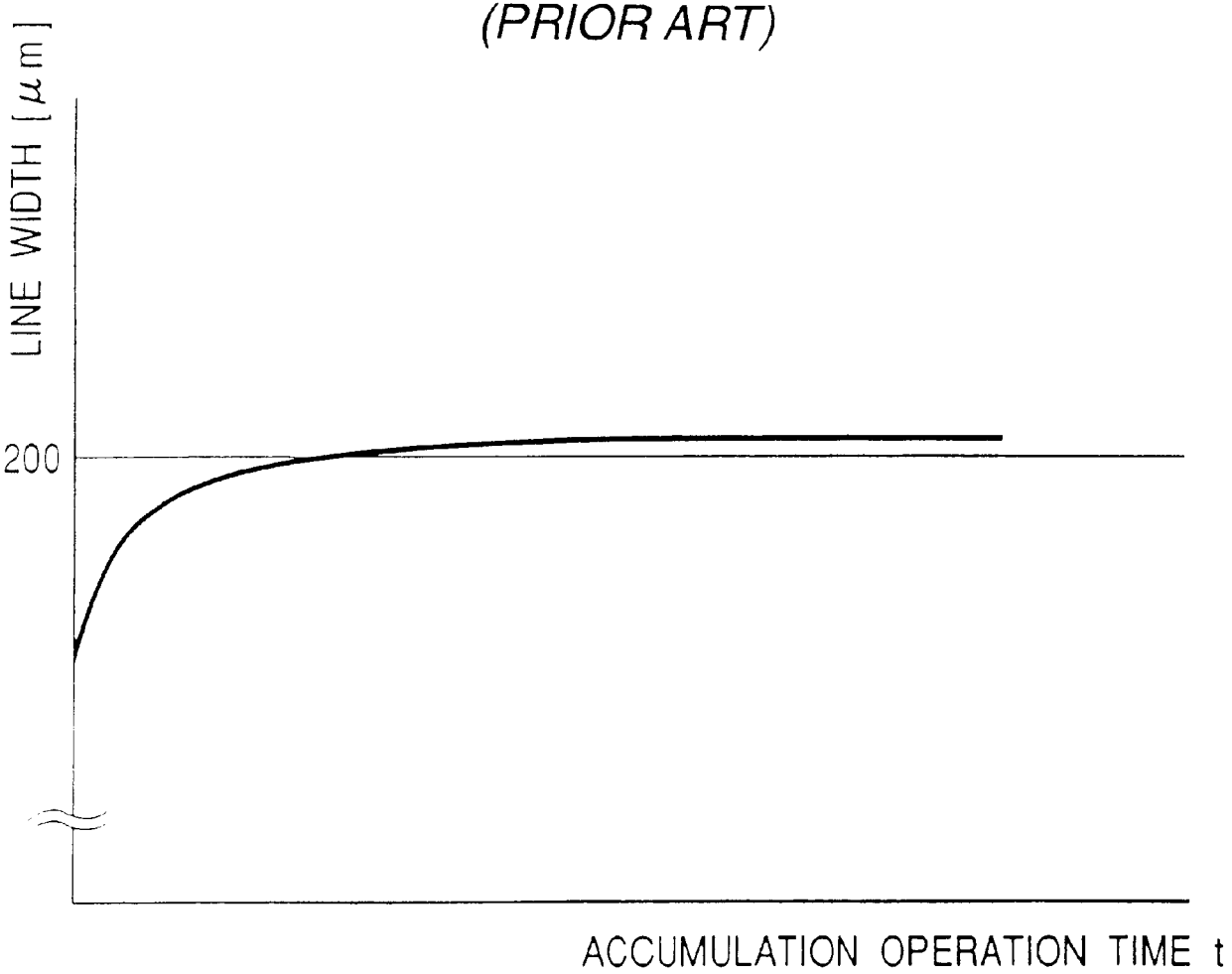
FIG. 10 (PRIOR ART)
FIG. 10 is a graph showing fluctuation in line width due to an accumulation operation of the conventional image forming apparatus.

FIG. 8 shows the relationship between the laser light amount (laser light intensity) and the light potential of the photosensitive drum. Here, the relationship between the laser light amount and the light potential of the photosensitive drum is obtained by changing only the laser light amount.

In FIG. 8, (1) denotes a light amount setting value when the accumulation electrifying time t is below $\Delta T1$ ($t<\Delta T1$), (2) denotes a light amount setting value when the accumulation electrifying time t is equal to or greater than $\Delta T1$ and below $\Delta T2$ ($\Delta T1\leqq t<\Delta T2$), and (3) denotes a light amount setting value when the accumulation electrifying time t is equal to or greater than $\Delta T2$ ($t\geqq\Delta T2$).

In this way, during the continuous usage of the process cartridge, by successively changing the laser light amount, the light potential of the photosensitive drum is controlled within a small fluctuating range in all of the accumulation operation amounts.

Further, similar to the above-mentioned embodiments, since image formation with a nearer reference value can be achieved when the initial changing amount is great and the changing timing is small or short, by setting the changing timing and the changing amount to be $\Delta T1=0.3\times\Delta T2$ and $\Delta V1=2\times\Delta V2$, respectively, an effect similar to the first embodiment can be achieved.

Incidentally, in the above-mentioned embodiments, while an example that the present invention is applied to the image forming apparatus to which the process cartridge (which can detachably be mounted to the main body of the image forming apparatus) is mounted was explained, the present invention can be applied to an image forming apparatus to which the developing apparatus, i.e., developing cartridge (which can detachably be mounted to the main body of the image forming apparatus) is mounted and can be applied to an image forming apparatus in which the developing apparatus is fixedly mounted to the main body of the image forming apparatus. In this case, the storing means is preferably provided on the developing cartridge.

As apparent from the above explanation, by changing the image forming condition in accordance with the accumulation operation amount parameter of the process cartridge or the image forming apparatus, the fluctuation in the image forming property due to the accumulation operation of the process cartridge or the image forming apparatus can be reduced, thereby obtaining a high quality image stably.

What is claimed is:

1. An image forming apparatus comprising:

image forming means for forming an image on a recording material;

storing means for storing a parameter regarding an accumulation operation amount of said apparatus; and changing means for changing an image forming condition of said image forming means in accordance with the parameter, wherein a changing amount of the image forming condition becomes smaller as a changing number of the image forming condition is increased.

2. An image forming apparatus according to claim 1, wherein the image forming condition is changed whenever the parameter reaches a predetermined value.

3. An image forming apparatus according to claim 1, wherein said storing means stores a set value of the image forming condition or the changing amount.

4. An image forming apparatus according to claim 1, wherein the parameter is represented by t(N) and a relationship between the parameter t(N) for changing the image forming condition and a changing number N of the image forming condition satisfies the following relationship:

$$t(N+2)-t(N+1)>t(N+1)-t(N)>t(1)$$

where N is an integral number greater than 1.

5. An image forming apparatus according to claim 4, wherein said storing means stores the parameter t(N) for changing the image forming condition.

6. An image forming apparatus according to claim 1, wherein said image forming means includes an image bearing member and toner image forming means for forming a toner image on said image bearing member, and the image forming condition is a toner image forming condition of said toner image forming means.

7. An image forming apparatus according to claim 6, wherein said toner image forming means includes electrostatic latent image forming means for forming an electrostatic latent image on said image bearing member and developing means for developing the electrostatic latent image with toner, and the toner image forming condition is at least one of an electrostatic latent image forming condition and a developing condition of said developing means.

8. An image forming apparatus according to claim 7, wherein said electrostatic latent image forming means includes electrifying means for electrifying said image bearing member, and the parameter is an accumulation electrifying time during which said image bearing member is electrified by said electrifying means.

9. An image forming apparatus according to claim 7, wherein the parameter is an accumulation developing time during which said image bearing member is developed by said developing means.

10. An image forming apparatus according to claim 7, wherein said developing means is detachably mountable to a main body of the image forming apparatus.

11. An image forming apparatus according to claim 6, wherein the parameter is an accumulation rotating time of said image bearing member.

12. An image forming apparatus according to claim 1, wherein the parameter is an accumulation image forming number of recording materials.

13. An image forming apparatus according to claim 1, wherein the image forming apparatus is associated with a cartridge detachably mountable to a main body of the image forming apparatus, and said cartridge has said storing means.

14. An image forming apparatus comprising:

image forming means for forming an image on a recording material;

a cartridge detachably mountable to a main body of the image forming apparatus;

storing means provided on said cartridge and adapted to store a parameter regarding an accumulation operation amount of said cartridge; and changing means for changing an image forming condition of said image forming means in accordance with the parameter, wherein a changing amount of the image forming condition becomes smaller as a changing number of the image forming condition is increased.

15. An image forming apparatus according to claim 14, wherein the image forming condition is changed whenever the parameter reaches a predetermined value.

16. An image forming apparatus according to claim 14, wherein said storing means stores a set value of the image forming condition or the changing amount.

17. An image forming apparatus according to claim 14, wherein the parameter is represented by t(N) and a relationship between the parameter t(N) for changing the image forming condition and a changing number N of the image forming condition satisfies the following relationship:

$$t(N+2)-t(N+1)>t(N+1)-t(N)>t(1)$$

where N is an integral number greater than 1.

18. An image forming apparatus according to claim 17, wherein said storing means stores the parameter t(N) for changing the image forming condition.

19. An image forming apparatus according to claim 14, wherein said image forming means includes an image bearing member and toner image forming means for forming a toner image on said image bearing member, and the image forming condition is a toner image forming condition of said toner image forming means.

20. An image forming apparatus according to claim 19, wherein said toner image forming means includes electrostatic latent image forming means for forming an electrostatic latent image on said image bearing member and developing means for developing the electrostatic latent image with toner, and the toner image forming condition is at least one of an electrostatic latent image forming condition and a developing condition of said developing means.

21. An image forming apparatus according to claim 20, wherein said electrostatic latent image forming means includes electrifying means for electrifying said image bearing member, and the parameter is an accumulation electrifying time during which said image bearing member is electrified by said electrifying means.

22. An image forming apparatus according to claim 20, wherein the parameter is an accumulation developing time during which said image bearing member is developed by said developing means.

23. An image forming apparatus according to claim 20, wherein said cartridge includes said developing means.

24. An image forming apparatus according to claim 23, wherein said cartridge includes said image bearing member.

25. An image forming apparatus according to claim 20, wherein said electrostatic latent image forming means includes electrifying means for electrifying said image bearing member, and said cartridge includes said image bearing member and said electrifying means.

26. An image forming apparatus according to claim 19, wherein the parameter is an accumulation rotating time of said image bearing member.

27. An image forming apparatus according to claim 14, wherein the parameter is an accumulation image forming number of recording materials.

28. An image forming apparatus comprising:

image forming means for forming an image on a recording material;

storing means for storing a parameter regarding an accumulation operation amount of said apparatus; and changing means for changing an image forming condition of said image forming means in accordance with the parameter, wherein the parameter is represented by t(N) and a relationship between the parameter t(N) for changing the image forming condition and a changing number N of the image forming condition satisfies the following relationship:

$$t(N+2)-t(N+1)>t(N+1)-t(N)>t(1)$$

where N is an integral number greater than 1.

29. An image forming apparatus according to claim 28, wherein said storing means stores the parameter t(N) for changing the image forming condition.

30. An image forming apparatus comprising:

image forming means for forming an image on a recording material;

storing means for storing a parameter regarding an accumulation operation amount of said apparatus; and changing means for changing an image forming condition of said image forming means in accordance with the parameter, wherein said image forming means includes an image bearing member and toner image forming means for forming a toner image on said image bearing member, and the image forming condition is a toner image forming condition of said toner image forming means, wherein said toner image forming means includes electrostatic latent image forming means for forming an electrostatic latent image on said image bearing member and developing means for developing the electrostatic latent image with toner, and the toner image forming condition is at least one of an electrostatic latent image forming condition and a developing condition of said developing means, and wherein said electrostatic latent image forming means includes electrifying means for electrifying said image bearing member, and the parameter is an accumulation electrifying time during which said image bearing member is electrified by said electrifying means.

31. An image forming apparatus according to claim 30, wherein the image forming apparatus is associated with a cartridge detachably mountable to a main body of the image forming apparatus, and said cartridge has said storing means.

32. An image forming apparatus comprising:

image forming means for forming an image on a recording material;

a cartridge detachably mountable to a main body of the image forming apparatus;

storing means provided on said cartridge and adapted to store a parameter regarding an accumulation operation amount of said cartridge; and changing means for changing an image forming condition of said image forming means in accordance with the parameter, wherein the parameter is represented by t(N) and a relationship between the parameter t(N) for changing the image forming condition and a changing number N of the image forming condition satisfies the following relationship:

$$t(N+2)-t(N+1)>t(N+1)-t(N)>t(1)$$

where N is an integral number greater than 1.

33. An image forming apparatus according to claim 32, wherein said storing means stores the parameter t(N) for changing the image forming condition.

34. An image forming apparatus comprising:

image forming means for forming an image on a recording material;

a cartridge detachably mountable to a main body of the image forming apparatus;

storing means provided on said cartridge and adapted to store a parameter regarding an accumulation operation amount of said cartridge; and changing means for changing an image forming condition of said image forming means in accordance with the parameter, wherein said image forming means includes an image bearing member and toner image forming means for forming a toner image on said image bearing member, and the image forming condition is a toner image forming condition of said toner image forming means, wherein said toner image forming means includes electrostatic latent image forming means for forming an electrostatic latent image on said image bearing member and developing means for developing the electrostatic latent image with toner, and the toner image forming condition is at least one of an electrostatic latent image forming condition and a developing condition of said developing means, and wherein said electrostatic latent image forming means includes electrifying means for electrifying said image bearing member, and the parameter is an accumulation electrifying time during which said image bearing member is electrified by said electrifying means.

35. An image forming apparatus according to claim 34, wherein said cartridge includes said image bearing member.

* * * * *